US006167968B1

(12) United States Patent
Allarie et al.

(10) Patent No.: US 6,167,968 B1
(45) Date of Patent: Jan. 2, 2001

(54) METHOD AND APPARATUS FOR RADIALLY DRILLING THROUGH WELL CASING AND FORMATION

(75) Inventors: Michael M. Allarie, Lacombe; Grant D. McQueen, Red Deer County; Robert Marcin, St. Albert, all of (CA); Alan D. Peters, Midland, TX (US)

(73) Assignee: Penetrators Canada, Inc., Alberta (CA)

( * ) Notice: Under 35 U.S.C. 154(b), the term of this patent shall be extended for 0 days.

(21) Appl. No.: 09/072,457

(22) Filed: May 5, 1998

(51) Int. Cl.[7] ..... E21B 43/112
(52) U.S. Cl. ..... 166/298; 166/55.2; 175/62
(58) Field of Search ..... 166/55.2, 298, 166/331; 175/62, 67, 78, 267

(56) References Cited

U.S. PATENT DOCUMENTS

| | | | | |
|---|---|---|---|---|
| 2,516,421 | * | 7/1950 | Robertson | 175/62 |
| 4,185,705 | * | 1/1980 | Bullard | 175/78 |
| 4,355,685 | * | 10/1982 | Beck | 166/331 |
| 4,640,362 | * | 2/1987 | Schellstede | 166/55.3 |
| 5,107,943 | * | 4/1992 | McQueen et al. | 166/55 |
| 5,392,858 | * | 2/1995 | Peters et al. | 166/298 |
| 5,687,806 | * | 11/1997 | Sallwasser et al. | 175/62 |

* cited by examiner

*Primary Examiner*—Eileen D. Lillis
*Assistant Examiner*—John Kreck
(74) *Attorney, Agent, or Firm*—Jacobson, Price, Holman & Stern, PLLC

(57) ABSTRACT

An apparatus for drilling holes in the steel casing of an a oil or gas well, and drilling into the surrounding earth, includes a number of components controlled by hydraulic fluid. A first hydraulic motor drives a steel milling assembly and a second hydraulic motor drives a rock drilling assembly. All assemblies are supported in a housing that is conveyed by conventional jointed pipe or coiled tubing down the well casing. Control components cause a carriage carrying the milling assembly to be indexed up a predetermined distance relative to the well casing, and then extend a mill bit gradually into contact with the well casing while being rotated by a hydraulic motor. After the mill bit completes a hole through the well casing, the hydraulic components retract the mill bit and index the carriage back down to its starting position to align a rock drilling bit with the hole that was just drilled in the casing. The rock drilling bit is provided on the outer end of a flexible drillstem to enable the rock bit to extend while drilling radially from the wellbore, through the hole in the casing, as it is rotated by the second hydraulic motor. The apparatus makes it possible to radially drill multiple holes through the metal casing and multiple corresponding long tunnels through surrounding earth, without having to be raised to the surface and re-lowered between operations.

17 Claims, 8 Drawing Sheets

TO FIG. 3D

METHOD AND APPARATUS FOR RADIALLY DRILLING THROUGH WELL CASING AND FORMATION

BACKGROUND OF THE INVENTION

1. Field of the Invention

The present invention relates to forming perforations in the casings of oil or gas wells. More specifically, the invention relates to apparatus and methods for cutting an opening in a well casing to permit subsequent drilling of a tunnel through surrounding earth for a substantial distance beyond the casing, for permitting the flow of liquid or gaseous hydrocarbons into the casing.

2. Related Art

In oil or gas wells, a contaminated zone is typically formed around the wellbore as a result of drilling fluids used during the drilling operation, and also as a result of the cement that is typically forced down into the bottom of a wellbore and up into the annular cavity between the well casing and the wellbore. This contaminated zone frequently presents a substantial barrier to the inflow of hydrocarbons to the well casing.

A number of expedients have been proposed and employed in an effort to provide flow passageways through the surrounding strata for permitting and increasing the flow of hydrocarbons into the well casing. For example, U.S. Pat. Nos. 4,790,384 and 5,107,943 show a method employing a cam drive cylinder means for driving a wedging cam to extend a radially moveable punch outwardly through the casing of a well.

Another common expedient for effecting casing and formation penetration is the use of explosive guns that fire projectiles or gas jets from a shaped charge through the well casing. These guns have limitations due to the compaction of the tunnels created by an explosion and on their limited penetration depth.

Other known systems involve separate mechanical cutting devices that are lowered to the bottom of the well. A first cutting device cuts a hole through the well casing and is subsequently removed from the well in order to permit the lowering and positioning of a nozzle jet-type cutter to cut into the surrounding formation. The positioning and removal of tools such as cutting devices to and from the well require time-consuming and expensive pulling and replacement of the pipe string extending above the tooling. With this known method, it can also be difficult to precisely locate the opening created by the mechanical cutting device at a deep well depth after the cutting device has been removed from the well. The foregoing problem is of substantial significance since the jet-type cutter must be accurately positioned adjacent the opening in order to function.

Other known systems involve radial drilling mechanisms that utilize a single drill bit mounted on a flexible drive shaft and are designed to drill through the well casing and radially outward into the surrounding strata for a short distance. These devices suffer from problems in successfully drilling repeatedly because the drill bit cannot effectively drill both the steel well casing and abrasive rock strata without excessive dulling.

Thus, there is a need in the art for a self-contained tool that can be run into an existing wellbore and repeatedly drill holes radially from the wellbore without the need for a turning radius outside the well casing. Applicants have recognized that this requires two drilling mechanisms: a first mechanism that is effective in drilling through steel well casing, and a second mechanism to effectively drill rock.

U.S. Pat. No. 5,392,858 (Peters et al.) describes a tool that mills a hole in the casing and then uses jetting to penetrate into the surrounding formation. A mill bit driven by a hydraulic motor mills a hole in well casing to allow passage of a high pressure fluid jet nozzle radially from the well casing into the surrounding formation. Although this apparatus enables both steps of the operation to be performed during a single trip into the well, it is limited by the fact that fluid jets are not efficient in deeply submerged environments even though high pumping pressures are employed at surface. The hydrostatic pressures encountered in downhole well operations greatly detract from the power of a fluid jet limiting its performance in many rock formation types. In addition, the high pumping pressures required increase the expense and danger of the operation, and it is difficult to convey the required pressures from surface to the tools in the bottom of the well.

Thus, there is a need in the art to provide a system for radially drilling through well casing that drills multiple holes through metal casing and multiple corresponding long tunnels through surrounding earth, without having to be raised and re-lowered between operations.

It is to fulfill the foregoing needs, among others, that the present invention is directed.

SUMMARY OF THE INVENTION

The invention provides an apparatus and method for drilling holes in the steel casing of an a oil or gas well, and for drilling into the surrounding earth. The apparatus includes a number of components that are preferably controlled by hydraulic fluid.

In a preferred embodiment, a first hydraulic motor drives a steel milling assembly and a second hydraulic motor drives a rock drilling assembly. All assemblies can be supported in a housing that is conveyed by conventional jointed pipe or coiled tubing down the well casing.

Control components cause a carriage carrying the milling assembly to be indexed up a predetermined distance relative to the well casing, and then extend a mill bit gradually into contact with the well casing while being rotated by a hydraulic motor. After the mill bit completes a hole through the well casing, the hydraulic components retract the mill bit and index the carriage back down to its starting position to align a rock drilling bit with the hole that was just drilled in the casing.

Preferably, the rock drilling bit is provided on the outer end of a flexible drillstem to enable the rock bit to extend while drilling radially from the wellbore, through the hole in the casing, as it is rotated by the second hydraulic motor.

The apparatus makes it possible to radially drill multiple holes through the metal casing and multiple corresponding long tunnels through surrounding earth, without having to be raised to the surface and re-lowered between operations.

Other objects, features and advantages of the invention will be apparent to those skilled in the art upon a reading of the following specification in accompaniment with the drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
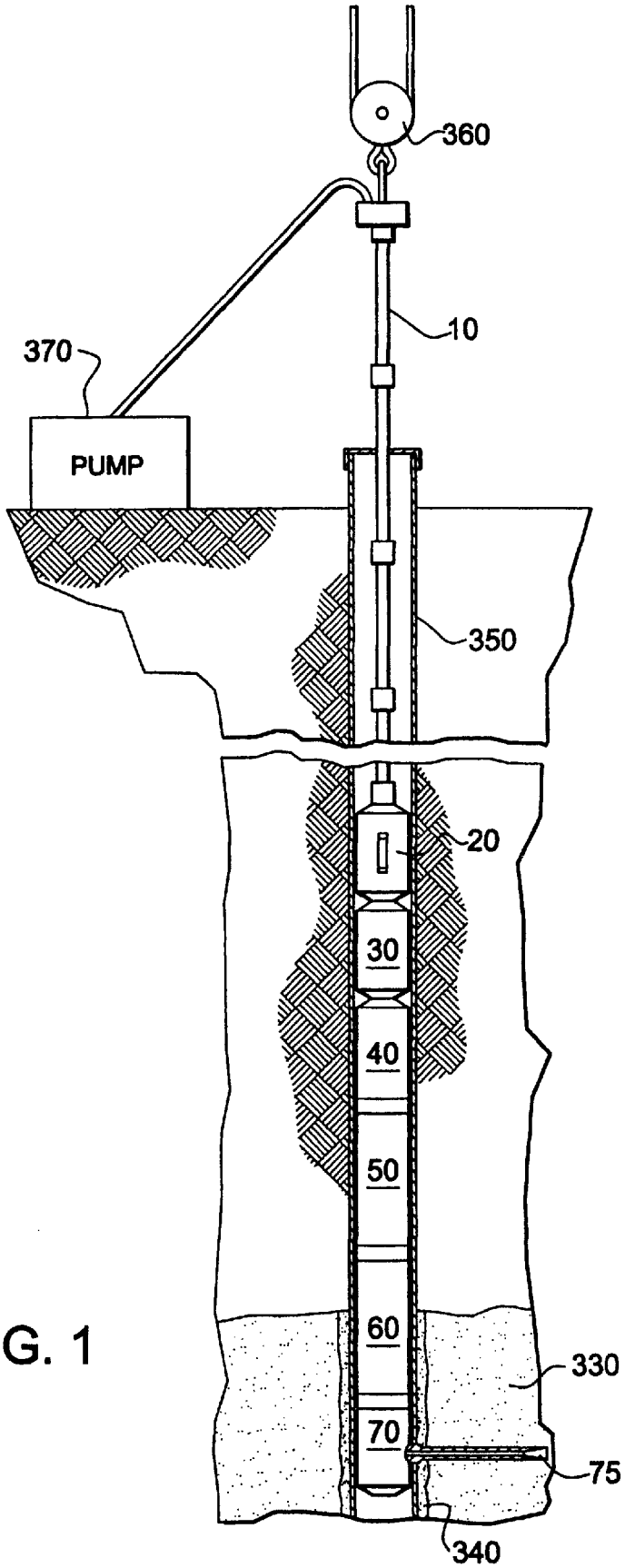
FIG. 1 schematically illustrates various major components of an embodiment of the inventive radial drilling apparatus as it might be deployed in a well.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Referring to FIG. 1, the preferred embodiment of the invention comprises an elongated, generally cylindrical housing capable of being lowered down a well casing. The apparatus operates based on pressurized working hydraulic fluid, and contains a mill bit for milling a hole through the metal well casing and a separate rock bit for drilling through surrounding earth. A lower hydraulic motor rotates the mill bit through a right angle drive. A spline assembly allows for simultaneous rotation and axial reciprocation of the mill bit so as to mill a hole through the well casing. An upper hydraulic motor rotates the rock drill bit through a spline assembly that allows for simultaneous rotation and reciprocation of a rock bit to drill radially into strata surrounding the well casing.

Control components are provided for assuring that whenever the lower hydraulic motor is running, it has been moved vertically upward a predetermined distance to an "index up" position that is adjacent a desired through-hole location on the well casing.

The control components also assure that the mill bit is only extended radially relative to the well casing into contact with the well casing when located at the index up position, and that the mill bit is extended at a controlled feed rate in order to prevent tool breakage or stalling of the hydraulic motor.

Further, the control components assure that whenever the upper hydraulic motor is running, the lower milling assembly has been moved to an "index down" position. In the "index down" position, the rock bit is aligned with the hole just milled in the well casing. The rock bit and a flexible drillstem are forced downward in the tool housing and around a ninety degree guide, at a controlled level of thrust.

More specifically, a hydraulic fluid control valve assembly, contained in a single housing at the top of the tool string, directs the flow of hydraulic working fluid sequentially to cause the following cycle of events to occur. Reference is generally made to the hardware diagrams of FIGS. 2 and 3 and the "operation sequence" flow chart of FIG. 4.

Pressure is applied to the tool from a surface pump to shift a valve to direct flow to the lower hydraulic motor, to apply pressure to a decentralizer piston, and to an "index up" cylinder and further increased to supply pressure to a mill piston, whereupon the already-rotating mill bit rotates and is forced radially to the well casing to mill a hole. Pressure is then decreased to cause retraction of the mill bit, and pressure is further decreased to cause the carriage assembly to move to the "index down" position that aligns the rock bit adjacent to the casing hole.

When pressure is then increased to a predetermined level, the upper hydraulic motor is fed and pressure is applied to a double-acting piston assembly to provide a controlled level of thrust to the rock bit via the flexible drillstem. As the rock bit and flexible drillstem are rotated, a pressurized piston forces them downward through a spline assembly that allows for rotation and axial reciprocation. The rock bit and drillstem are forced through a ninety degree guide to a direction perpendicular to the tool housing, so that a tunnel is drilled a predetermined distance into the surrounding strata.

Pressure is then decreased to reset the control valve, and increased to apply pressure to the double-acting piston assembly that pulls the drillstem back into the tool housing. As pressure is bled off, the valve resets and is in position to repeat the cycle.

The milling and carriage assembly may be designed with principles known to those skilled in the art. A suitable milling and carriage assembly are described in U.S. Pat. No. 5,392,858 (Peters et al., hereinafter "the '858 patent"). The '858 patent, and all documents mentioned in this specification, are incorporated herein by reference as if reproduced herein in full. The milling and carriage assembly are contained in a single housing at the lowest end of the tool string.

In a preferred embodiment, a rock drilling assembly is contained in two housings coupled together and located between an (upper) control valve housing and the (lower) mill housing. A hydraulic motor causes rotation of a spline assembly that allows for axial reciprocation of the entire drive line. The lower end of the spline is connected by threads to a double-acting piston assembly through which torque and thrust is supplied to a flexible drillstem and rock bit. A threaded coupling connects the flexible drillstem to the lower end of the piston. The lower piston of the double-acting piston assembly is pressurized through a control valve system during rotation of the rock drilling drive line, to force the drillstem downward and around the guide perpendicular to the wellbore.

The invention provides circulation of fluid to the rock bit to cool the bit and remove cuttings from the tunnel, simultaneously with rotation through a bore in a flexible coil wound drillstem. When drilling is complete, the control valve directs fluid pressure to the upper piston, causing the drive line to move upward in the tool housing, and retracting the rock bit and drillstem from the formation tunnel. The control valve system ensures that during all drilling functions the mill carriage assembly is held in the "index down" position to ensure that the rock bit is positioned accurately adjacent the hole milled in the casing.

Referring to FIG. 1, a preferred embodiment of the invention is shown in an oil well having a casing 350 extending downwardly through an oil bearing strata 330. The area immediately surrounding the casing at the bottom of the well normally includes a cement layer 340. Also, the strata is usually contaminated by drilling mud constituents forced into the matrix during the drilling operation. The cement and mud invasion are an impediment to fluid flow and impair the productivity of the well.

A preferred embodiment of the present invention is an elongated downhole apparatus suspended from surface by a hoisting mechanism 360 and a tubing string 10 that may be coiled tubing or a plurality of tubular pipe segments. The lower end of the tubing is connected to a suitable stabilizer/anchor 20. One anchor that is suitable for use with the invention is described in U.S. Pat. No. 5,107,943 (McQueen et al.).

A filter 30 is mounted below the stabilizer/anchor 20. The apparatus is connected to the lower end of the filter.

The preferred embodiment involves a combination of solid round bodies containing machined bores and drilled passages, and a plurality of connected tubular members, in which various functions and equipment are provided. In the following sections, the general function each of these sections is first described; thereafter, a more detailed description of their operation is presented.

Rotary Control Section (RCS) 40. The uppermost section of the exemplary apparatus is a rotary control section 40 (hereinafter referred to as the RCS), connected at its lower end to a motor section 50 by a suitable threaded collar. A suitable collar is described in the '858 patent mentioned above. The motor section 50 is connected to a drill section 60 and then to a mill section 70 by the same threaded collar connection mentioned above. The mill section 70 may be implemented as any suitable mill section, such as that described in detail in the '858 patent.

Referring more specifically to the details of the sections, the RCS 40 is a pressure-sensitive valve assembly that distributes hydraulic fluid to various parts of the apparatus at appropriate intervals in order to cycle the tools through their functions. The illustrated control section replaces the control and valve sections described in the '858 patent, combining their functions in a more compact and reliable section.

The supply of hydraulic fluid from the tubing 10 is split into five paths (or "circuits") within the RCS, as described in more detail with reference to FIG. 3:

index down path 900 mill extend path 910, mill motor run path (and decentralizer extend) 920, drill retract 930, drill extend (and decentralizer extend) path 940, These five pathways are delivered to the motor section 50 via hydraulic dowels that are mated into seal bores in the top sub of the motor section.

A nitrogen accumulator compensates for the variety of pressurized atmospheres in which the tool must function, given that it must work in wells at varying depths, submersed in fluids of varying density, and that the wells may or may not be full of fluid. The RCS 40 contains an extend valve designed to allow for extension and retraction of the mill cutter (FIG. 2, element 270) used in the mill section 70 to create the hole in the steel casing 350.

Figure 2A:
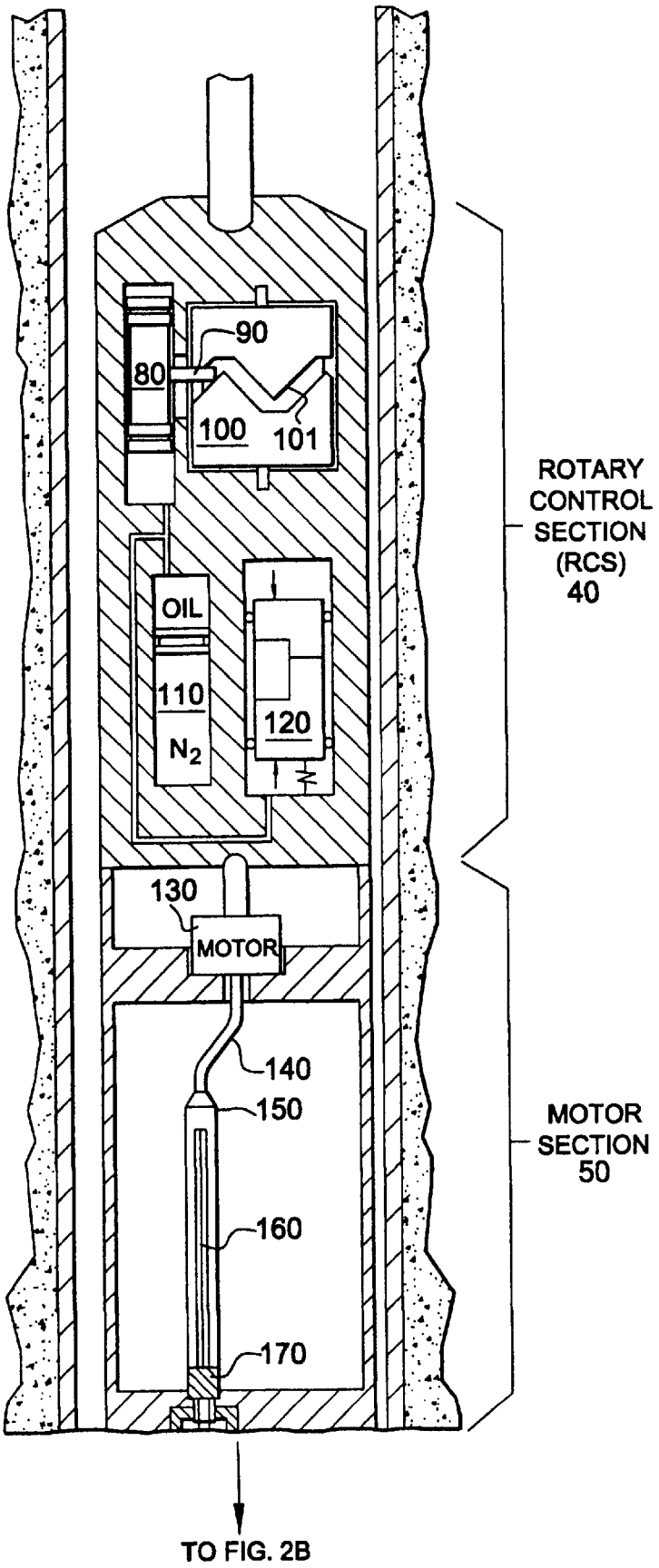
FIGS. 2A and 2B (collectively referred to herein as "FIG. 2") illustrate the details of a rotary control section 40, a motor section 50, a drill section 60, and a mill section 70 of the embodiment of FIG. 1.

A three-position actuator drum (or "J" drum) 100 shown in FIG. 2A is a cylinder with an offset flow path through it. The "J" drum is activated by reciprocating axial movement of a pin 90 engaged in a continuous "J-slot" 101, such that axial movement of the pin causes rotational movement of the "J" drum. The offset flow path in the "J" drum is alternately aligned with three flow paths to different parts of the tool assembly. The principles used in the '858 patent are also applied in the present RCS, although in a more durable configuration.

Figure 2B:
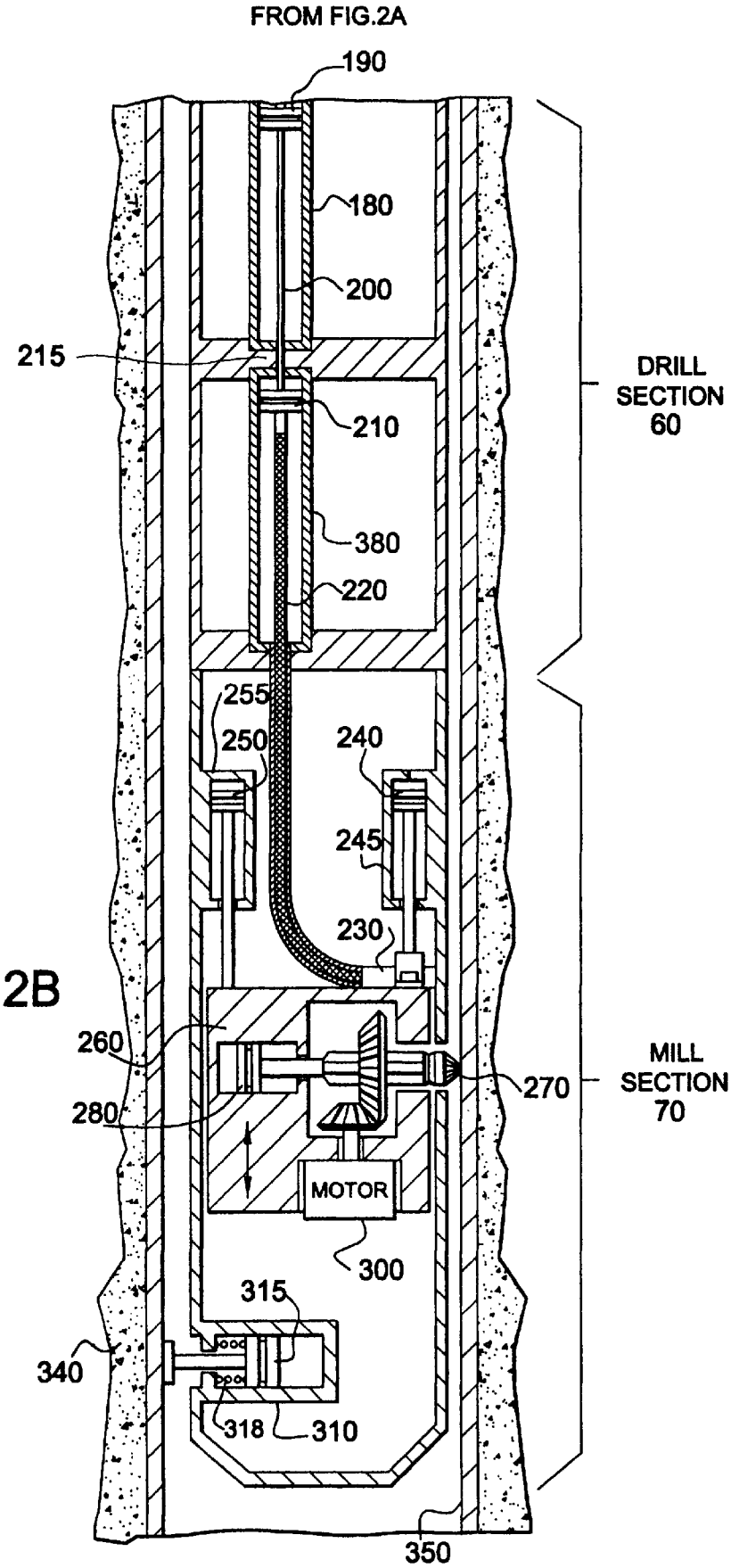

Referring to FIGS. 1–3, the RCS 40 receives pressurized hydraulic fluid from the surface pumping equipment 370 via the tubing 10, anchor 20 and filter 30. It initially divides that flow into three paths 900, 901, and 902 (FIG. 3A), and via a combination of drilled passages and hydraulic connections delivers pressurized fluid to an index down circuit line 900, an actuator piston 80, and the actuator ("J") drum 100, respectively.

The index down line 900 passes directly through this section in preparation for delivery to the motor section 50 and eventually to the index-down pistons 250 of the mill section 70.

Flow via path 901 to an actuator piston 80 applies downward force to it, and works to overcome upward force being exerted by energized oil from nitrogen accumulator 110, which is directed to the bottom face of the actuator piston 80 via paths 903 and 904. If the combined pressure of the tubing hydrostatic plus the pump pressure exceeds the nitrogen pressure, the actuator piston 80 moves downward.

Actuator piston 80 is keyed to the J-drum 100 by an actuator pin 90 (FIG. 2A). This axial movement is thereby translated into rotational movement of the J-drum 100 as the actuator pin is forced along the J-slot. The J-slot has six dwell positions, three at the lower limit and three at the upper limit of axial movement of the actuator pin 90.

Flow path 902 (FIG. 3A) supplies pressurized hydraulic fluid to the upper end of J-drum 100. This fluid travels through the J-drum 100 via an offset passage. Due to this offset, the exit point of this passage is not in the center of the J-drum 100, and rotation causes the exit point to describe a specific circumference larger than zero since the J-drum 100 is concentrically pinned at each end. This exit point is mechanically sealable to a smooth mating surface connected to three separate passages 920, 930, and 940, whose entrance points are spaced 120 degrees apart along that specific circumference.

The three dwell positions at the lower limit of travel of the actuator piston 80 are timed to bring the offset exit into alignment with the three continuing flow passages 920, 930, 940. The three dwell positions at the upper limit of travel of the actuator piston 80 do not align with a continuing passage and therefore do not allow for any fluid transmission out of J-drum 100.

Figure 3A:
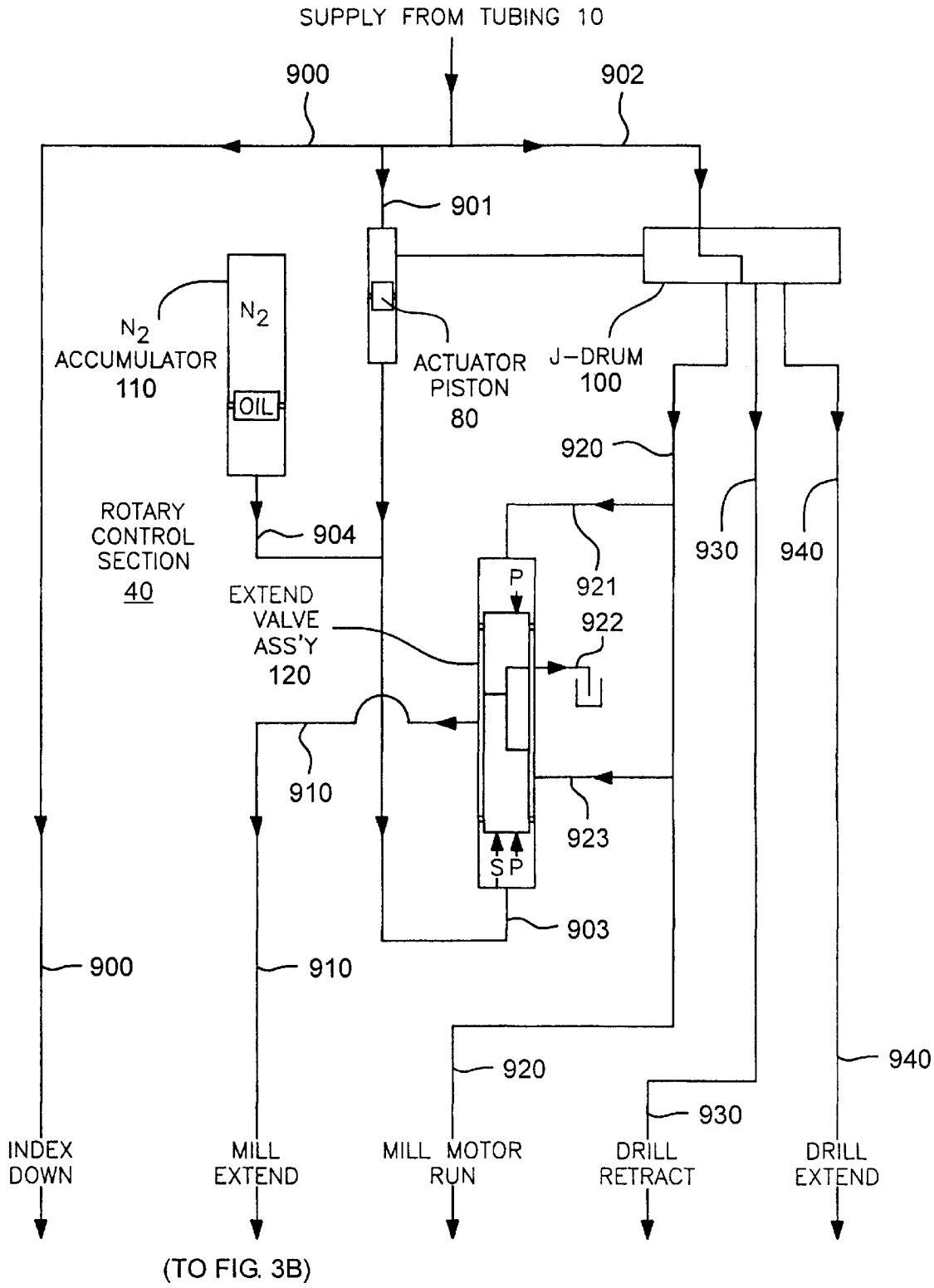
FIGS. 3A through 3D (collectively referred to herein as "FIG. 3") schematically illustrate various hydraulic connections of the rotary control section 40, motor section 50, drill section 60, and mill section 70, respectively, according to a preferred embodiment of the present invention.
Figure 3B:
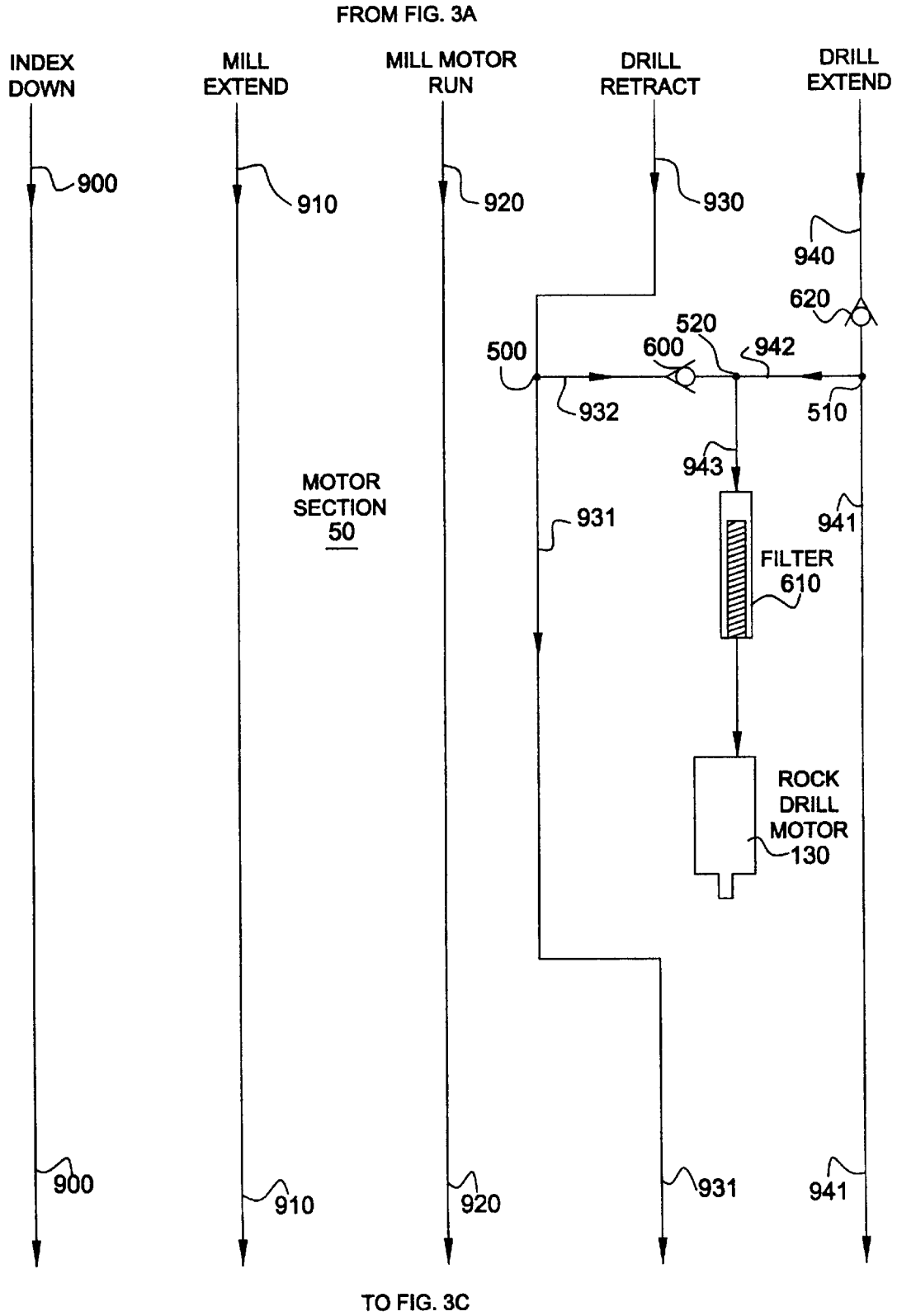
Figure 3C:
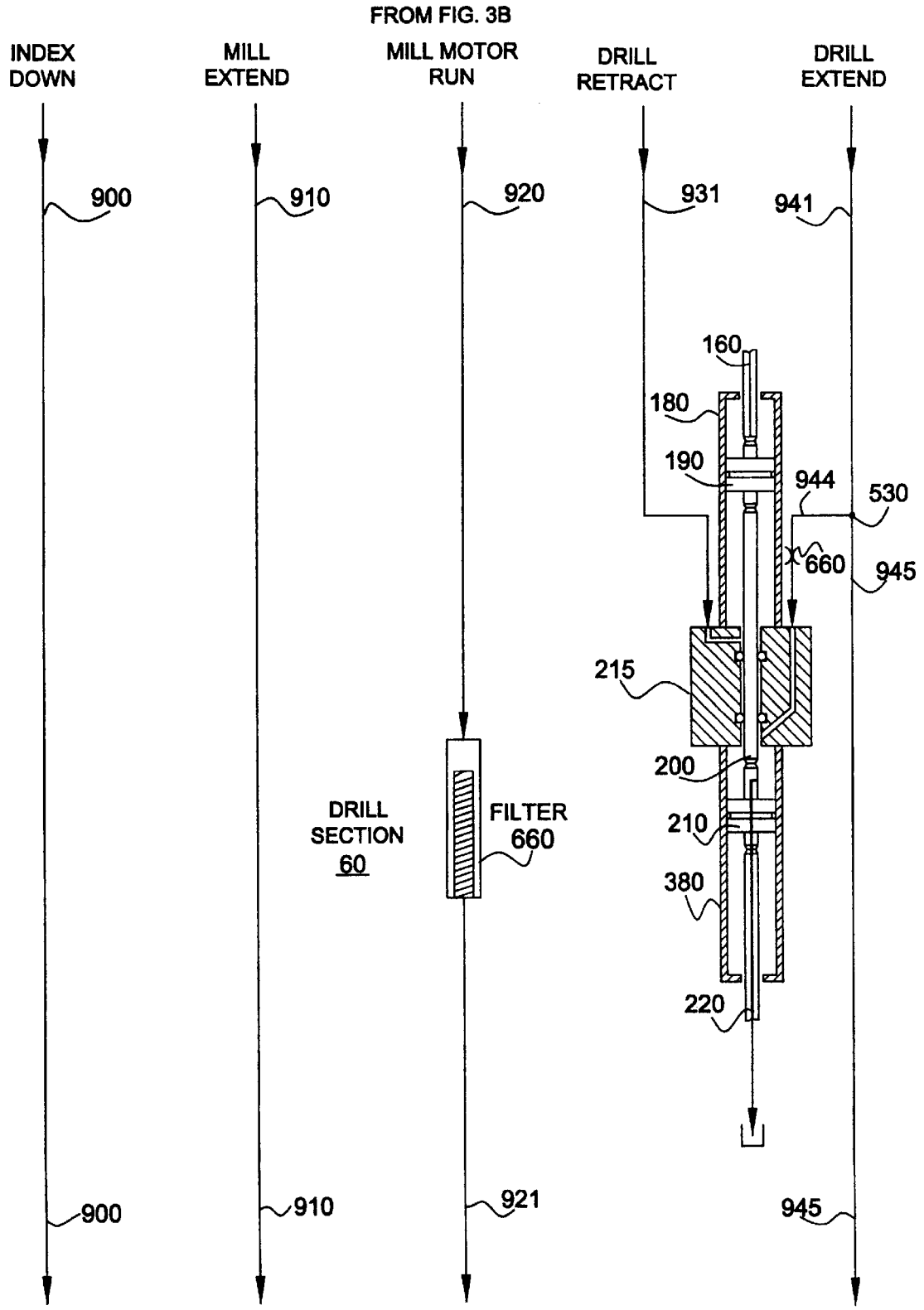

Of the three passages leading from the J-drum 100, two pass uninterrupted through the balance of the control section and are delivered to the motor section 50 (FIG. 3B). These two passages are the drill retract passage 930 and drill extend passage 940. The third line, the mill motor run passage 920, has two additional passages 921 and 923 teed off of it, before it is delivered to the motor section 50. These two teed passages 921, 923 supply hydraulic fluid to an extend valve assembly 120 (FIG. 3A) that controls extension and retraction of the mill cutter 270. This extend valve assembly 120 may (for example) be implemented as the corresponding assembly described in the '858 patent.

Path 921 supplies fluid pressure to one end of a spool valve piston in the extend valve assembly 120. Axial movement of this piston is controlled by a balance of pressure in the mill motor run line 921 at one end versus the sum of (nitrogen pressure via path 903 plus spring force) at the other end. The addition of the spring force into the equation means that shifting of the J-drum 100 occurs prior to shifting of the extend valve as pressures are being increased. This control arrangement ensures that the mill cutter 270 is rotating and indexed up into milling position before it is extended to contact casing 350. This control arrangement also ensures that, as pressure is being reduced after the casing hole has been milled, the cutter retracts from that hole before carriage 260 is indexed down.

The second teed passage 923 connects to the interior of the extend valve assembly 120. If the sum, nitrogen pressure plus spring force, is greater than the force being exerted by pressure from the mill motor run line 921, the position of the spool valve piston is such that fluid entry from this second teed line 923 is substantially blocked, and any fluid that does get into the interior of the assembly has a clear path to be exhausted to atmosphere via path 922. Therefore, no significant pressure is transmitted down the mill extend line 910 under this circumstance.

However, when pressure in branch 921 of the mill motor run line 920 exceeds the force exerted by the sum, nitrogen pressure plus spring force, the spool valve piston shifts axially and blocks the exhaust port 922 while simultaneously aligning flow with the mill extend line 910. In this event, fluid has a clear path into the interior of the extend valve assembly 120. Since the exhaust port 922 is now substantially blocked, pressure is transmitted via mill extend line 910 to the extend side of the cutter piston 280, and forces the piston 280 (FIG. 3D) and cutter 270 to extend toward casing 350.

Motor Section 50. The primary function of the motor section 50 is to supply the rotational movement required by the rock drill bit 230 in order to drill drain tunnels into the rock formation 330, and to allow for simultaneous axial movement of the rotating and travelling drive assembly. The motor section receives the five hydraulic circuits (paths) from the RCS. Three of these circuits pass directly through the motor section 50 in preparation for delivery to the drill section 60, namely, the index down path 900, the mill extend path 910, and the mill motor run path 920.

After being received into the motor section 50, the drill extend line 940 is teed off at tee 510 (FIG. 3B). One branch 941 is plumbed directly through to the bottom end of the motor section for delivery to the drill section 60. The other branch 942 is teed again at tee 520.

One branch 932 (FIG. 3B) of tee 520 would flow back up the drill retract line 930 but is prevented from doing so by a check valve 600. The second branch 943 from tee 520 connects to rock drill motor 130 via a filter 610. Rock drill motor 130 uses the hydraulic fluid supplied from the drill extend line 940/942 to rotate a flexible drive shaft 140 (FIG. 2A). The flexibility of drive shaft 140 compensates for misalignment between the motor 130 and a hollow drive tube 150.

The hollow drive tube 150 receives rotational movement from rock drill motor 130 via the flexible drive shaft 140, and transmits that rotation to an axially moveable splined shaft 160 (FIG. 2A) via a transfer bushing 170 at the bottom of the drive tube 150. The transfer bushing 170 is keyed to the drive tube 150, and rotates with it. The splined shaft 160 mates with the transfer bushing 170, and receives rotation from the transfer bushing 170 while still being free to move axially through the transfer bushing 170 up or down within the hollow center of the drive tube 150.

Drill retract path 930 is teed off from a first tee 500 (FIG. 3B). One of the lines 931 passes directly through the balance of the motor section 50 and is delivered to the drill section 60. The other branch 932 passes through check valve 600 which is connected to another tee 520.

From tee 520, one line 943 is connected to the rock drill motor 130 through filter 610 to supply rotation to the assembly while retracting. The other side of tee 520 is connected to tee 510 via line 942 and then to the drill extend line 940. Fluid is then free to flow down the drill extend line 941 to supply flushing fluid to the rock bit 230 and flexible drillstem 220 as they are retracted. Check valve 620 in the drill extend line 940 above tee 510 prevents backflow up the drill extend line 940.

The Drill Section 60. Drill section 60 supplies thrust and axial movement required to advance the rock bit 230 as it drills into the rock formation 330, and to retract it after the tunnel is complete.

The drill section 60 (FIG. 3C) contains a double acting piston to extend or retract the rock bit as required, and allows for constant rotation of the travelling assembly during these procedures. The drill section connects to the lower end of the motor section 50, and receives five hydraulic circuits from the motor section 50, namely:

index down path 900
mill extend path 910
mill motor run path 920,
the drill retract path 931, and
drill extend path 941.

Index down line 900 and mill extend line 910 pass directly through the drill section for delivery to the mill section 70. Fluid in the mill motor run line 920 passes through filter 660 before being delivered to mill section 70.

The drill retract line 931 is plumbed into the drill retract cylinder 180, and exerts force on the retract piston 190 when energized. This retraction force causes the rock bit 230 to be retracted from the tunnel it has made in the rock formation 330.

The drill extend line 941 is teed off within the drill section 60 at tee 530. One branch 945 passes directly to the bottom of the drill section for delivery to the mill section 70 where it activates a decentralizer mechanism in the same manner as explained in the '858 patent.

The other branch 944 passes through a flow control device 660 that is connected to the drill extend cylinder 380. When energized, it exerts a controlled amount of forward thrust on the drill extend piston 210 and thus on the flexible drillstem 220 and rock bit 230. The drill extend piston 210 has drilled passages within it that allow fluid to pass into the hollow core of the flexible drillstem 220. This passage allows for transmission of cooling/flushing fluid to the rock bit 230.

In addition to receiving the above-mentioned five hydraulic circuits from the motor section 50, the drill section 60 receives rotation by means of a connection from the splined drive shaft 160 to retract piston 190. Retract piston 190 is sealed to the inner bore of a retract cylinder 180 and maintains that seal while rotating and moving axially. Retract piston 190 is connected to a drill piston rod 200 whose exterior is sealed within the intermediate drill cylinder assembly 215, near the midpoint of the drill section 60 and connects to the top of the drill extend piston 210.

The drill extend piston 210 is sealed to the inner bore of the extend cylinder 380 and maintains that seal while rotating and travelling axially. When energized, extend piston 210 exerts thrust on the flexible drillstem 220 and thereby on the rock bit 230. The entire travelling assembly comprised of splined drive shaft 160, retract piston 190, drill piston rod 200, extend piston 210, flexible drillstem 220 and rock bit 230 is advanced together.

When the drill retract circuit 931 is energized, the entire travelling assembly retracts and pulls flexible drillstem 220 and rock bit 230 back into the tool. During both the extension and retraction sequences, the entire travelling assembly is also rotating, and fluid exits rock bit 230 to cool the rock bit and flush cuttings back into the wellbore.

Mill Section 70. A suitable implementation of portions of the mill section 70 is described in the '858 patent. A description of features important to the present invention is provided as follows.

Figure 3D:
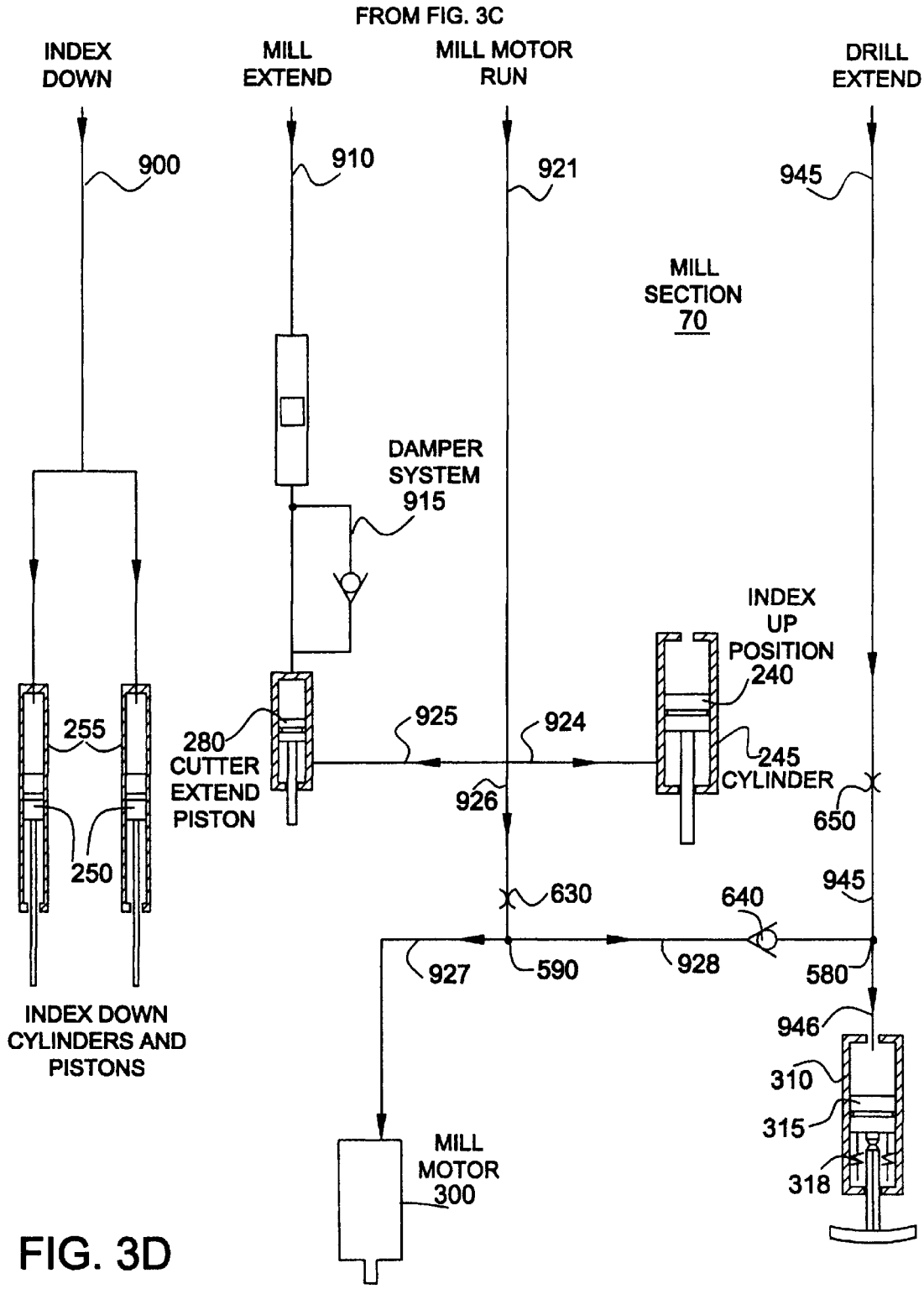

Referring especially to FIG. 3D, mill section 70 receives four hydraulic circuits from the drill section 60, namely:

index down 900, mill extend 910, filtered mill motor run 921, and drill extend 945.

The index down line 900 is connected to the index down cylinders 255 and the index down pistons 250, and receives whatever pressure exists at the top of the RCS 40, regardless of which function the tools are performing. Thus, whenever there is pressure in the tubing string 10, there is force at all times trying to hold a carriage 260 in the index down position. Indexing carriage 260 up to the "index up" (or milling) position is achieved by means of a larger piston 240 in the index up cylinder 245 that is able to overcome the opposing force exerted by the index down pistons 250.

The mill motor run circuit 921 is initially split into three passages 924, 925, 926 within mill section 70.

First passage 924 is connected to the index up piston 240, and when energized, overcomes the opposing force of the index down pistons 250 and causes carriage 260 to move (or index) up to the desired location for the hole to be made in the steel casing 350.

Second passage 925 is connected to the top side of the cutter extend piston 280. Whenever path 925 is energized, retraction force is exerted on the upper side of the cutter extend piston 280, and mill cutter 270 retracts if unopposed by force on the opposite side.

Third passage 926 continues through a flow control device 630 to a tee 590. A first path 927 from tee 590 supplies hydraulic fluid to a mill motor 300, which supplies rotation to mill cutter 270 in order to mill the required hole in the steel casing 350. A second path 928 from tee 590 passes through a check valve 640 which is connected to a tee 580 in the drill extend line 945.

A first path 946 leading from tee 580 is connected to a decentralizer 310 that holds the tool assembly to the side of the wellbore where the hole in the casing 350 and subsequent drain hole in the rock formation 330 are to be made. A second path 945 from tee 580 allows flow back up the drill extend line, although the amount of flow is restricted by flow control device 650. This arrangement allows for pressure bleed-off in the seal bore of the decentralizer 310 to allow piston 315 to be retracted by means of an opposing spring 318.

The drill extend line 945 is received from the drill section 60 and passes through flow control device 650 and then to the tee 580 that is connected with the mill motor run line 921. One side of the tee 580 is connected via path 946 to the decentralizer 310. The other side 928 of tee 580 would flow back up the mill motor run line 928 but is prevented from doing so by a check valve 640.

The mill extend line 910 is energized as the extend valve 120 (FIG. 3A) shifts. The mill extend line 910 connects to the lower side of the cutter piston 280 via an oil damper system 915, where it overcomes the opposing retraction force and extends the cutter piston 280; Thus, the cutter 270 is extended at a controlled rate.

As pressure is reduced after completing the hole in the casing 350, the extend valve 120 (FIG. 3A) resets and cuts off pressure supply to the lower side of the cutter 270. Therefore, pressure from the still-energized mill motor run circuit 925 causes the mill cutter 270 to retract.

Figure 4:
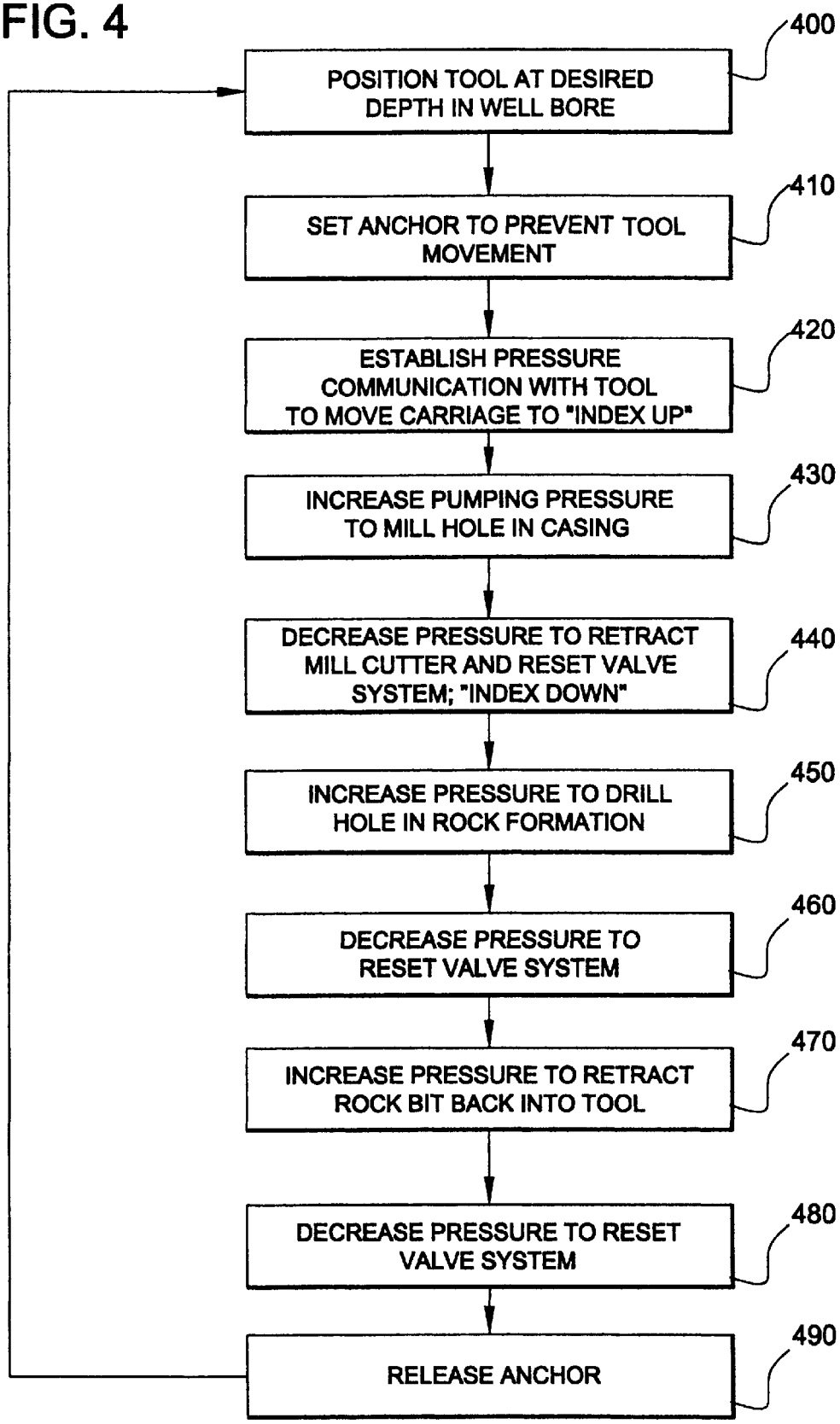
FIG. 4 is an "operation sequence" flow chart showing steps in a preferred embodiment of the radial drilling method according to the present invention.

Operational Sequence. Referring to FIG. 4, a flow chart indicating major steps in a preferred embodiment of the inventive method is provided. The steps are summarized in sequence.

400: The drilling apparatus is positioned in the wellbore at a desired depth by hoisting mechanism 360 (FIG. 1).

410: The tool is anchored to prevent it from moving with respect to the well casing during the drilling operation. This anchoring is accomplished by use of the stabilizer/anchor 20 (FIG. 1).

420: Using pump 370 (FIG. 1), hydraulic pressure is established in the tool via hydraulic lines leading down to it. At this time, the carriage 260 having mill cutter 270 is moved upward within the tool housing to its "index up" position, where the mill cutter is positioned at the desired location for the hole. The decentralizer foot is activated at this time to stabilize the tool's position and orientation.

430: Pumping pressure is increased so as to cause mill cutter 270 (FIG. 2) to mill a hole in casing 350 at the desired location.

440: The hydraulic pressure is decreased so as to retract the mill cutter and reset the hydraulic valve system that controls operation of the drilling apparatus. At this time, the carriage 260 is lowered to its "index down" position so that rock bit 230 is positioned opposite the hole that has just been milled in the well casing. Pressure to the decentralizer 310 is relieved and it retracts.

450: The hydraulic pressure is again increased so the rock bit 230 is extended through the hole in the casing. Rock bit 230 is rotated so as to drill a hole in the strata surrounding the well. The decentralizer is pressurized and extended during the rock drilling operation.

460: When the hole in the strata is completed, hydraulic pressure is again decreased, causing the hydraulic valve system to again be reset and the decentralizer to retract.

470: Hydraulic pressure is increased to retract the rock bit 230 from the hole and back into the tool inside the wellbore.

480: Hydraulic pressure is again decreased to reset the hydraulic valve system.

490: The stabilizer (anchor) is released and the apparatus can be positioned at a different height for drilling subsequent holes, as indicated by element 400.

In view of the foregoing disclosure, it is clear to those skilled in the art that the inventive radial drilling tool provides advantages over conventional drilling systems. Many conventional lateral or horizontal drilling systems are large-diameter, expensive systems that require a significant turn radius (such as 30 feet) in order to deviate from vertical to horizontal. In contrast, the inventive radial drilling tool requires no turn radius outside the tool housing because it fits entirely within an existing wellbore.

Other conventional systems claim to be able to drill perpendicular to the wellbore, but they have drawbacks such as the need to pull one drilling assembly out after a hole is made in the well casing so that a second drilling or jetting assembly can be run to then be sent through the casing hole to drill radially into rock-two trips are required to make one tunnel. Still other known systems involve tools that claim to be able to drill through casing and continue radially into rock with a single bit, which is not practical as it is known that bits that drill steel casing dull very rapidly while drilling through rock (as acknowledged in U.S. Pat. No. 5,687,806).

Further, many conventional drilling systems do not appear to have the ability to circulate fluid through the bit in order to clear cuttings, yet it is impossible to drill any significant distance without this ability. The invention's flexible drill-stem with the rock bit on its end has an internal bore to facilitate fluid circulation during drilling, to both cool the bit and clear cuttings out of the drilled tunnel. The inventive radial drilling tool is believed to be the only self-contained tool that can make multiple penetrations on a single run in the well with no mechanical manipulation from surface other than pumping hydraulic fluid and repositioning the tool for each subsequent penetration.

Moreover, the inventive tool indexes an internal carriage hydraulically to allow the steel casing to be drilled with one bit, and then drills the surrounding rock with a second bit. This allows the use of bits that are properly designed for each purpose. The tool does not use a single bit that does neither job very well.

Optimum thrust on the drill bits is hydraulically controlled. The tool can be conveyed into a well by either conventional jointed pipe or by coiled tubing. All stroking mechanisms to extend and retract both drilling systems are contained and actuated internally in the tool, and the tool housing never moves with respect to the surface as it is anchored to the inner casing wall during drilling.

Modifications and variations of the above-described embodiments of the present invention are possible, as appreciated by those skilled in the art in light of the above teachings. For example, it is not necessary that the tool be divided into separate "sections," and the components carrying out the functions of the control section, motor section, drill section and mill section may be arranged and distributed differently than as specifically described above while still remaining within the scope of the invention. It is therefore to be understood that, within the scope of the appended claims and their equivalents, the invention may be practiced otherwise than as specifically described.

What is claimed is:

1. A method of drilling radially through a well casing into surrounding geological formation, using a downhole drilling tool positioned in the well casing positioned in the geological formation and having a movable carriage that supports and guides a milling bit having a design for efficient drilling through the well casing and a rock bit having a construction for efficient drilling into the surrounding geological formation, the method comprising effecting the following steps solely by pumping fluid to the tool at varying rates and pressures;

positioning the carriage in a first position so that the milling bit is positioned opposite a point on the well casing at which it is desired to drill a hole;

drilling a hole with the milling bit generally radially through the well casing;

withdrawing the milling bit from the hole in the well casing;

re-positioning the carriage to a second position so that the rock bit is opposite the hole using means for controlling radial extension of the rock bit relative to the casing and rotation of the rock bit in the well casing;

extending the rock bit through the hole; and drilling a tunnel in the geological formation extending outwardly from the hole in the well casing using the rock bit.

2. A drilling apparatus for drilling radially through a well casing into surrounding formation, the apparatus comprising:

(a) an elongated, generally cylindrical, housing;

(b) a movable carriage mounted for lengthwise movement in said elongated generally cylindrical housing that includes:

(1) a milling bit best adapted to drill through the well casing, (2) a rock bit best adapted to drill through the surrounding formation;

(c) control means for controlling operation of the milling bit, the rock bit, and the carriage, including:

(1) first means for controlling radial extension relative to the casing and rotation of the milling bit;

(2) second means for controlling radial extension relative to the casing and rotation of the rock bit;

(3) third means for positioning the carriage relative to said elongated generally cylindrical housing so that the milling bit is positioned in a work position in which it is aligned with a point on the well casing at which it is desired to drill a hole in the casing; and (4) fourth means for re-positioning the carriage so that the rock bit is positioned in said work position so as to permit movement of the rock bit outwardly through a hole drilled in the casing by the milling bit.

3. The apparatus of claim 2 wherein said control means additionally includes:

an actuator piston;

an actuator pin moving integrally with the actuator piston; and an actuator drum mounted for rotation and including a slot into which the actuator pin extends and plural output hydraulic paths that are sequentially energized with hydraulic fluid as the actuator drum moved through plural positions by said actuator pin and wherein the slot is curved so that when the actuator piston moves axially, the actuator pin moves in the slot so as to rotate the actuator drum; and the plural output hydraulic paths from the actuator drum control the first means for controlling, the second means for controlling, the third means for positioning and the fourth means for repositioning.

4. The apparatus of claim 2, further comprising:

means for anchoring the drilling apparatus at a desired depth in the well.

5. The apparatus of claim 2, wherein:

the first, second, third and fourth means include respectively hydraulically-controlled piston-cylinder arrangements and wherein said first and second means operate solely by employing varying flow rates and pressures.

6. The apparatus of claim 5 wherein:

the respective hydraulically-controlled piston-cylinder arrangements are located downhole, and operate in response to hydraulic pressure from a pump that is located uphole.

7. The apparatus of claim 2, wherein said control means further includes:

a hydraulically actuated actuator piston;

an actuator pin moving integrally with the actuator piston; and an actuator drum having a slot into which the actuator pin fits for effecting sequential rotation of the actuator drum in response to actuation of the actuator piston and plural output hydraulic paths that are sequentially energized with hydraulic fluid as the actuator drum rotates sequentially into different positions;

wherein the slot is curved so that when the actuator piston moves axially, the actuator pin moves in the slot so as to rotate the actuator drum; and the plural output hydraulic paths from the actuator drum control the first, second and third means.

8. The apparatus of claim 2, wherein the first means includes:

a mill extend hydraulic line; and a mill motor run hydraulic line.

9. The apparatus of claim 2, wherein the second means includes:

a drill retract hydraulic line; and a drill extend hydraulic line.

10. The apparatus of claim 2, wherein the third means includes:

an "index up" piston and cylinder arrangement that operates in response to a mill motor run hydraulic line into which hydraulic force is applied intermittently.

11. The apparatus of claim 2, wherein the fourth means includes:

an "index down" piston and cylinder arrangement that operates in response to an index down hydraulic line in which hydraulic force is applied continuously.

12. The apparatus of claim 2 wherein said second means includes a flexible drillstem on which said rock bit is mounted and means providing thrust and rotation to said flexible drillstem.

13. The apparatus of claim 12 wherein said flexible drillstem additionally includes a hollow core through which cooling/flushing fluid is supplied to the rock bit.

14. The apparatus of claim 12 wherein said control means additionally includes:

an actuator piston;

an actuator pin moving integrally with the actuator piston; and an actuator drum mounted for rotation and including a slot into which the actuator pin extends and plural output hydraulic paths that are sequentially energized with hydraulic fluid as the actuator drum moved through plural positions by said actuator pin and wherein the slot is curved so that when the actuator piston moves axially, the actuator pin moves in the slot so as to rotate the actuator drum; and the plural output hydraulic paths from the actuator drum control the first means for controlling, the second means for controlling, the third means for positioning and the fourth means for repositioning.

15. The apparatus of claim 2 wherein said second means comprises hydraulic cylinder means having a stroke exceeding the diameter of said housing and connected to said rock bit so as to move said rock bit radially outward of said housing a distance corresponding to said stroke.

16. A method of drilling radially through a well casing into surrounding geological formation, including providing a downhole drilling tool housing positioned in the well casing having an internal diameter and positioned in the geological formation and having a movable carriage that supports and guides a milling bit having a design for efficient drilling through the well casing and a rock bit having a construction different from the construction of the milling bit for efficient drilling into the surrounding geological formation, and effecting the following steps solely by pumping fluid to the tool at varying rates and pressures;

positioning the carriage in a first position so that the milling bit is positioned opposite a point on the well casing at which it is desired to drill a hole;

drilling a hole with the milling bit generally radially through the well casing;

withdrawing the milling bit from the hole in the well casing;

re-positioning the carriage to a second position so that the rock bit is opposite the hole in the well casing;

rotating and extending the rock bit through the hole to effect the drilling of a bore in the geological formation extending outwardly from the hole in the well casing using means for controlling radial extension of the rock bit relative to the casing and rotation of the rock bit.

17. The method of claim 16 wherein the drilling provides a bore extending through the geological formation a distance exceeding the internal diameter of the well casing.

* * * * *